US005425524A

United States Patent [19]

Messina, Jr.

[11] Patent Number: 5,425,524

[45] Date of Patent: Jun. 20, 1995

[54] LEVELING AND GUIDING DEVICE FOR HANGING OBJECTS

[76] Inventor: Sebastian J. Messina, Jr., 29 Running Hills Dr., Newton, N.J. 07860

[21] Appl. No.: 42,779

[22] Filed: Apr. 2, 1993

[51] Int. Cl.[6] ..... A47G 1/16

[52] U.S. Cl. ..... 248/475.1; 248/489

[58] Field of Search ..... 248/466, 475.1, 489, 248/476, 490, 493, 495, 497

[56] References Cited

U.S. PATENT DOCUMENTS

| | | | |
|---|---|---|---|
| 2,588,009 | 3/1952 | Jones | 248/489 |
| 3,261,578 | 7/1966 | Hinebaugh | 248/489 |
| 3,861,639 | 1/1975 | Morrill | 248/489 |
| 4,315,615 | 2/1982 | Scocozza | 248/489 |
| 4,340,199 | 7/1982 | Brock | 248/490 X |
| 4,437,639 | 3/1984 | Stein | 248/489 X |
| 4,591,125 | 5/1986 | Bellehumeur | 248/495 X |

FOREIGN PATENT DOCUMENTS

| | | | |
|---|---|---|---|
| 2422369 | 12/1979 | France | 248/489 |

*Primary Examiner*—Alvin C. Chin-Shue
*Assistant Examiner*—Derek J. Berger

[57] ABSTRACT

A hanging device for wall mountable objects comprising a wall mountable support and an object mountable support wherein the wall mountable support defines a structure with inertial properties for self-leveling and retentive and guidance features and wherein the object mountable support defines a complimentary form sized for receipt into the wall mountable support and wherein engaged the object mountable support is oriented into a horizontal attitude for display of wall mountable objects.

1 Claim, 2 Drawing Sheets

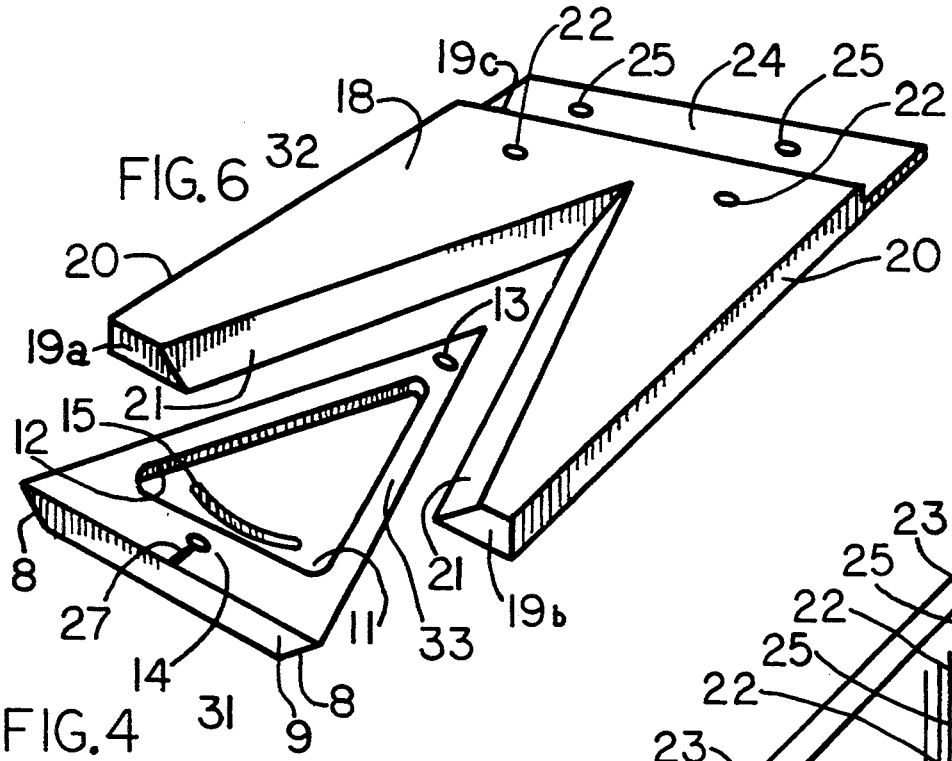
FIG. 6
FIG. 4
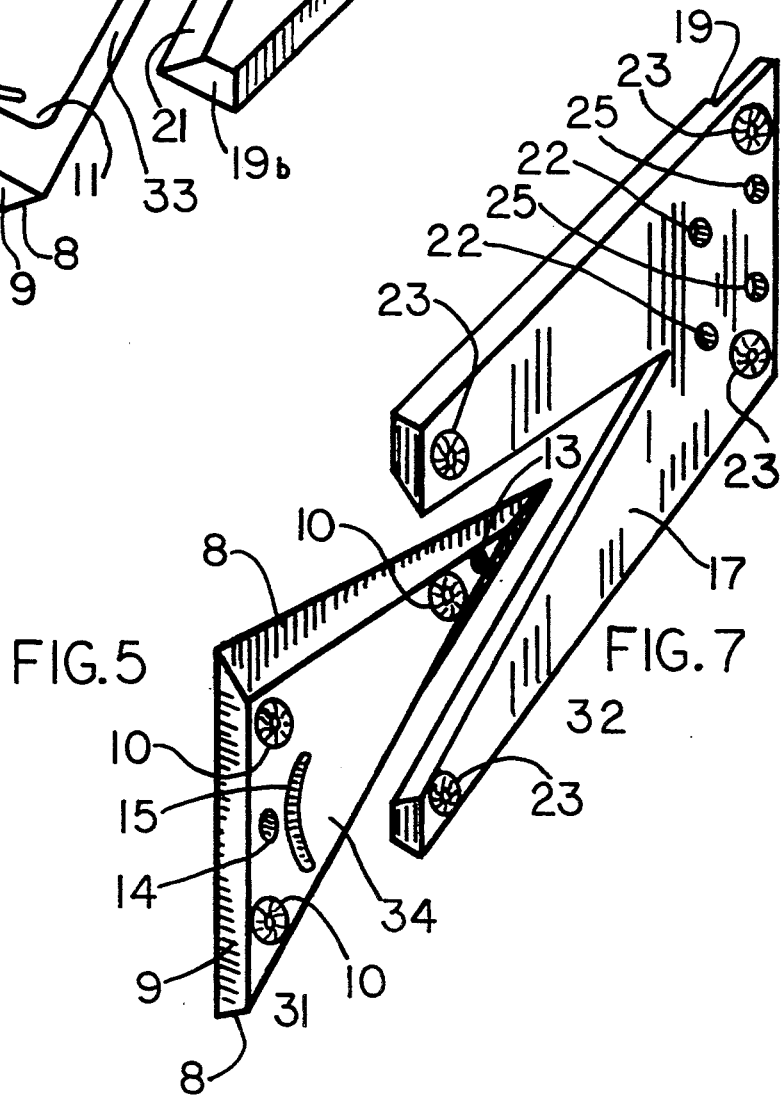
FIG. 5
FIG. 7

LEVELING AND GUIDING DEVICE FOR HANGING OBJECTS

FIELD OF INVENTION

This invention relates to a wall hanging device, and more particularly, to a wall hanging device which provides means for guiding, supporting and hanging in a horizontal attitude a wall mountable object.

BACKGROUND OF THE INVENTION

In hanging objects on the wall it is preferable to level, guide and support the objects. Thus, devices created for these applications require sighting, shuffling parts and single points of support; making these tasks difficult to achieve and time consuming.

In prior art, the most common method of hanging objects to a wall is making use of a wire and hook, thus requiring assembly of wire to eyelets, shuffling for wire to mate with the hook and the effort of leveling such objects. Other prior art make use of bubble levels, which adds cost and requires sighting the device, a task only as accurate as the bubble level itself and the individual doing the sighting.

The difficult and time consuming tasks of the prior art are put to an end by the instant invention wherein a uniquely shaped wall mountable hanging device with a round aperture for pivoting provides the method of hanging objects relative to a horizontal attitude and per its shape provide a method of guiding and retaining said objects.

OBJECTIVE OF THE INVENTION

It is the object of this invention to provide an improved and novel hanging device for wall mountable objects comprised of a wall mount support that is self positioning to a horizontal attitude and an object mountable support.

Another object of this invention is to provide an inexpensive method of leveling utilizing the center of gravity and inertial effects about an aperture for pivoting, as contrasted to bubble levels in prior art.

A further object is to provide better accuracy in leveling. Sighting for current bubble leveling devices can introduce error in the leveling function. The combination of the round aperture, shape and inertial characteristics allows gravity to consistently bring the wall mountable support to a horizontal attitude.

A further object is to provide a method of guiding the wall mountable objects onto the wall mount support, as opposed to prior art which requires shuffling components or placing wires on hooks.

Another object is to provide a means of retaining the wall mountable object and provide a large bearing surface as to increase the strength of the hanging device. Prior art provides small bearing surfaces or points of support, as with a hook and wire.

A further object is to provide a cost effective part not limited to one method of fabrication or one material. Prior art provides many complex features which, when produced, require large quantities of material and complex tooling.

A further object is to provide a device used for determining reference to a horizontal attitude.

DESCRIPTION OF DRAWINGS

FIG. 4 is a perspective view of the wall mount support viewing the vertical face surface.

FIG. 5 is a perspective view of the wall mount support viewing the vertical wall surface.

FIG. 6 is a perspective view of the object mount support viewing the vertical picture surface.

FIG. 7 is a perspective view of the object mount support viewing the vertical rear surface.

DESCRIPTION OF THE PREFERRED EMBODIMENT

Figure 1:
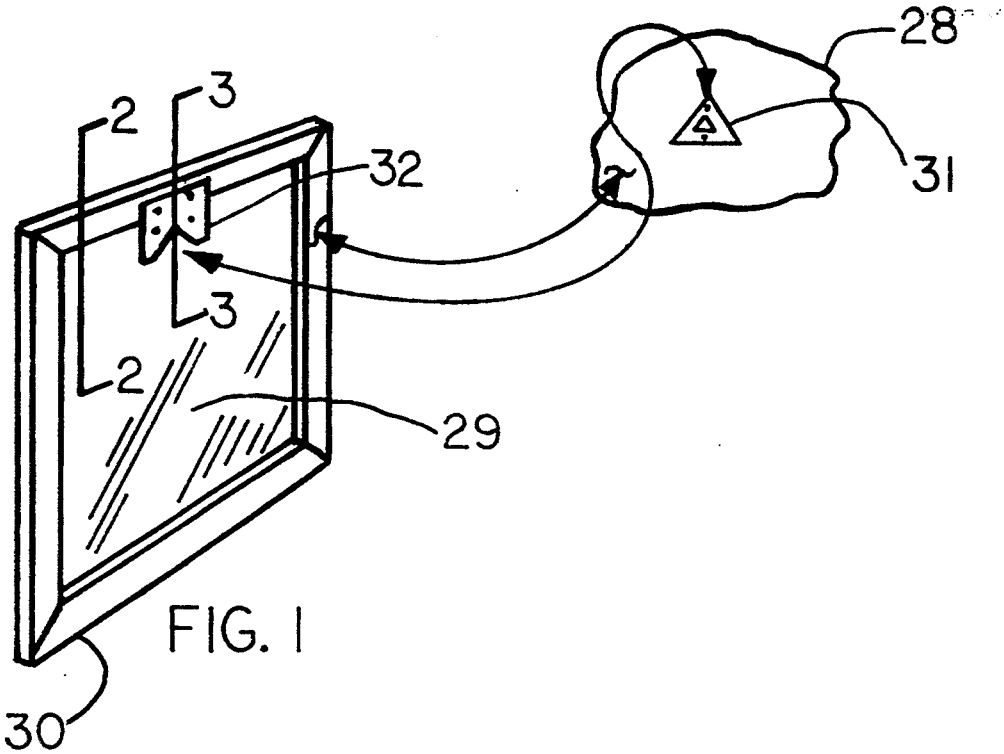
FIG. 1 is a perspective view depicting the components of the instant invention in use.
Figure 2:
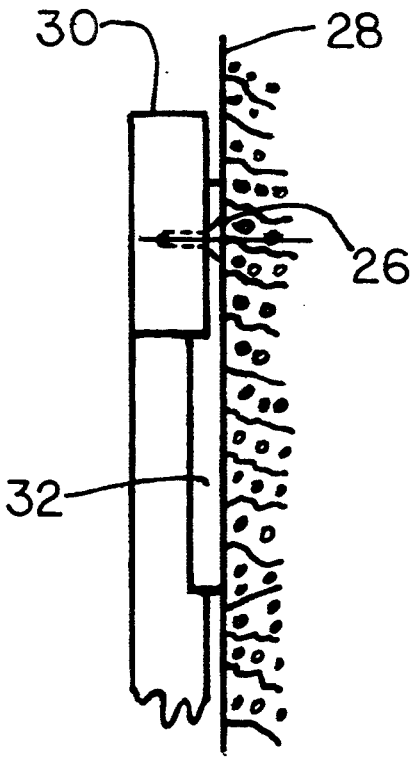
FIG. 2 is a cross reference view of the instant invention in use.
Figure 3:
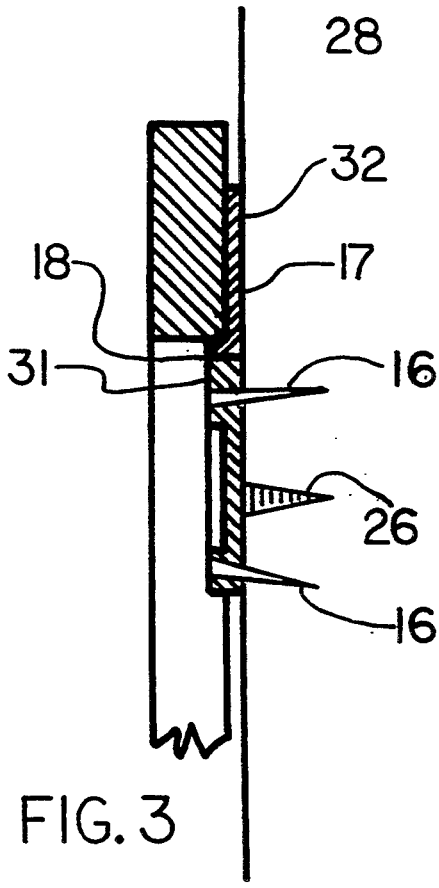
FIG. 3 is a cross sectional view depicting the object mount support number 32 mounted to a picture frame number 29 engaged to the wall mount support number 31 mounted to the wall number 28.

In the illustration given and with reference to FIG. 1 the number 28 designates a wall surface and number 29 an object to be supported. In the particular illustration given the object in number 29 is a picture having a rectangular frame number 30 (usually constructed of wood). The frame 30 is intended to be level to the horizon, guided and retained to the wall 28 by means of a wall mount support number 31 mounted to the wall 28 and an object mount support number 32 mountable to the frame 30.

Referring more in detail to the wall mount support 31 in FIG. 4 and FIG. 5, it is seen that included is a vertical face surface number 33 and a smaller vertical wall surface number 34 of common shape to surface 33. Three sides connect the face surface 33 to the wall surface 34, one horizontal side number 9 and two tapered sides number 8 which project upward at equal slope from each end of horizontal side 9 intersecting forming an inverted "v" shape. Included on the wall surface 34 are three rounded portions number 10. The face surface 33 includes a surface number 11 at a lower elevation than the face surface. Connecting the face surface 33 to surface 11 is a continuous interior side wall number 12 extending from surface 11 to the face surface 33 in a tapered fashion.

The face surface 33 is provided, intermediate of the horizontal side 9 positioned on the face side 33, a center indicating line number 27, which may be suitably formed as a raised rib or scribing.

The wall mount support 31 is also provided with an aperture number 13 extending through the wall mount support and through which a nail number 16 is extended for pivotal purposes. A second aperture number 14 is provided, through which preferably a nail is extended, for securing the wall mount support 31 to the wall 28.

A third elongated curved aperture number 15 is provided, through which preferably a screw number 26 is extended, for additional support of the wall mount support 31 to the wall 28.

Referring more in detail to the object mount support 32 in FIG. 6 and FIG. 7, it is seen that included is a vertical rear surface number 17 and a vertical picture surface number 18. Seven sides connect the vertical rear surface 17 to the vertical picture surface 18. Three horizontal sides numbers 19*a*, 19*b* and 19*c*, two vertical sides number 20 and two tapered sides number 21. The two tapered sides 21 project upward at equal slope from the two lower horizontal sides 19*a* and 19*b*, intersecting forming an inverted "v" shape.

The object mount support 32 is also provided with four rounded portions number 23 extending at right angles from the general axis of the vertical rear surface 17.

Object mount support 32 is also provided with a vertically extending portion number 24, preferably rectangular in configuration, so that the length of the vertically extending portion 24 is equal to the vertical rear surface 17 extending therefrom at a right angle from horizontal side 19. Included in the vertically extended portion 24 are two apertures number 25, preferably through which a screw 26 may extend to secure the object mount support 32 to the picture frame 30.

The object mount support 32 also is provided with two apertures number 22, through which optionally screws may extend, for securing the object mount support 32 to a rectangular frame 30.

In use of the leveling and guiding device for hanging objects, the object mount support 32 is secured to the rectangular frame 30 by passing screws through the apertures 25 into the frame 30. An optional method to secure the object mount support 32 is by passing screws through the apertures 22 into the frame 30.

In securing the wall mount support 31 to the wall 28, the wall surface 34 of the wall mount support 31 is placed against the wall. A nail 16 is extended through the aperture 13 into the wall 28.

A force applied to surface 8 will provide a pendular motion about aperture 13, where gravity and inertial properties stop the motion of the wall mount support 31, bringing surface 9 to a horizontal attitude.

A second nail is extended through the aperture 14, securing the wall mount support 31 to the wall 28. An optional method is to secure the wall mount support 31 by passing a screw 26 through aperture 15 into the wall 28.

The rectangular frame 30, with the secured object mount support 32, is positioned over the secured wall mount support 31 and guided onto the wall mount support 31 by means of the two tapered sides 21. The object mount support 32 engages the wall mount support 31 in a restraining fashion.

While the instant invention has been shown and described herein in what is conceived to be the most practical and preferred embodiment, it is recognized that departures may be made therefrom within the scope of the invention, which is not to be limited to the details disclosed herein but is to be accorded the full scope of the claims so as to embrace any and all equivalent apparatus and articles.

I claim:

1. A device for hanging wall mountable objects in a self-aligning horizontal attitude comprising:

a. A generally planar wall mount member having a back for mounting against a wall, a front, an upper portion, a bottom edge and two sides angled outwardly from top to bottom, said wall mount member further comprising self-aligning means comprising a laterally centered aperture located in the top portion with a fastener therethrough, whereby gravity causes the wall mount member to pivot about said fastener in a pendular motion until said lower edge rests in a horizontal attitude;

said side edges further being chamfered inwardly from front to back; and b. a generally planar object mount member with a front for mounting an object and a generally inverted v-shaped interior, said interior being configured to mate with the chamfered side edges of said wall mount member, whereby as said object mount member is lowered onto said wall mount member, the chamfered side edges force the object mount member rearwardly.

* * * * *